US008408393B2

(12) United States Patent
Buynak et al.

(10) Patent No.: US 8,408,393 B2
(45) Date of Patent: Apr. 2, 2013

(54) PACKAGED TOY WITH SELECTOR

(75) Inventors: Ryan Buynak, West Hollywood, CA (US); Yuk Ha Mo, Torrance, CA (US); Garrett Sander, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 191 days.

(21) Appl. No.: 12/579,126

(22) Filed: Oct. 14, 2009

(65) Prior Publication Data

US 2010/0136875 A1 Jun. 3, 2010

Related U.S. Application Data

(60) Provisional application No. 61/196,279, filed on Oct. 15, 2008.

(51) Int. Cl.
*B65D 85/00* (2006.01)

(52) U.S. Cl. ..... 206/459.1; 206/463; 206/470; 206/471

(58) Field of Classification Search ..... 206/459.1, 206/374, 376, 461–464, 466, 470, 471; 446/98, 446/103, 288, 486, 259, 71.73, 75, 97, 99, 446/321, 77; 434/99
See application file for complete search history.

(56) References Cited

U.S. PATENT DOCUMENTS

| | | | | |
|---|---|---|---|---|
| 198,589 A | | 12/1877 | Fabronius | |
| 211,528 A | | 1/1879 | Shelton | |
| 247,302 A | | 9/1881 | Candy | |
| 261,775 A | | 7/1882 | Smith | |
| 702,615 A | | 6/1902 | Barden | |
| 1,064,576 A | * | 6/1913 | Washburn | 273/155 |
| 1,148,540 A | | 8/1915 | Sancier | |
| 1,272,685 A | | 7/1918 | Levis | |
| 1,340,160 A | | 5/1920 | Duff | |
| 1,496,406 A | | 6/1924 | Bertsch | |
| 1,530,404 A | | 3/1925 | Pearce | |
| 1,636,371 A | | 7/1927 | Kenney | |
| 1,703,159 A | | 2/1929 | Monheim | |
| 1,762,374 A | | 6/1930 | Yancey | |
| 1,961,973 A | | 6/1934 | Jenkins | |
| 2,461,926 A | | 2/1949 | Russell | |
| 2,476,194 A | | 7/1949 | Hollowell | |
| 2,669,802 A | | 2/1954 | Olivier | |
| 2,931,657 A | | 4/1960 | Lewis | |
| 2,935,814 A | | 5/1960 | Freeze | |
| 2,959,891 A | * | 11/1960 | Barnett et al. | 446/295 |
| 3,122,859 A | | 3/1964 | Reaux, Jr. | |
| 3,462,857 A | * | 8/1969 | Barlow et al. | 434/402 |
| 3,596,380 A | | 8/1971 | Williams | |

(Continued)

FOREIGN PATENT DOCUMENTS

JP 09-165044 A 6/1997

OTHER PUBLICATIONS

International Search Report for PCT/US2009/060664, dated May 19, 2010, 6 pages.

(Continued)

*Primary Examiner* — Luan K Bui
*Assistant Examiner* — Rafael Ortiz
(74) *Attorney, Agent, or Firm* — Edell, Shapiro & Finnan LLC

(57) ABSTRACT

The present disclosure is directed generally to product packaging and, more specifically, to product packaging assemblies with try-me toys that may allow a consumer to visualize, experiment, and design various looks available in the product line at the point of purchase while the product remains in the product packaging and after purchase.

21 Claims, 8 Drawing Sheets

U.S. PATENT DOCUMENTS

| | | | | | |
|---|---|---|---|---|---|
| 3,608,206 | A | | 9/1971 | Knott | |
| 3,717,942 | A | | 2/1973 | Presby | |
| 3,830,012 | A | | 8/1974 | Franke | |
| 3,961,439 | A | | 6/1976 | Moustakas | |
| 4,043,056 | A | | 8/1977 | Savage | |
| 4,136,483 | A | | 1/1979 | Shackelford et al. | |
| 4,226,030 | A | | 10/1980 | Quinn, III | |
| 4,411,382 | A | | 10/1983 | Taub | |
| 4,445,691 | A | | 5/1984 | Stark et al. | |
| 4,773,643 | A | * | 9/1988 | Mizunuma | 273/445 |
| 4,813,382 | A | | 3/1989 | Lindermann et al. | |
| 4,820,234 | A | | 4/1989 | Isaf | |
| D307,307 | S | | 4/1990 | Staake | |
| 4,979,324 | A | | 12/1990 | Rehtmeyer et al. | |
| 5,083,788 | A | | 1/1992 | Conotter | |
| 5,172,806 | A | | 12/1992 | Mickelberg | |
| 5,712,004 | A | * | 1/1998 | Lin | 428/33 |
| 5,788,232 | A | | 8/1998 | Binkley | |
| 5,855,499 | A | | 1/1999 | Yamazaki et al. | |
| 5,899,329 | A | * | 5/1999 | Hu et al. | 206/376 |
| 5,984,755 | A | | 11/1999 | Avey | |
| 6,012,842 | A | | 1/2000 | Openiano | |
| 6,146,721 | A | | 11/2000 | Freynet | |
| 6,206,750 | B1 | * | 3/2001 | Barad et al. | 446/268 |
| 6,244,439 | B1 | | 6/2001 | Dennis | |
| 6,280,283 | B1 | * | 8/2001 | Sisler | 446/100 |
| 6,604,976 | B2 | * | 8/2003 | Lenkoff | 446/73 |
| 6,743,020 | B2 | | 6/2004 | Pestl | |
| 6,790,117 | B2 | * | 9/2004 | Ruiz Gonzalez | 446/92 |
| 7,306,096 | B2 | * | 12/2007 | d'Auriac et al. | 206/301 |
| 7,384,325 | B2 | * | 6/2008 | Kelly et al. | 446/268 |
| 7,861,926 | B2 | * | 1/2011 | Sheldon et al. | 235/380 |
| 2004/0005838 | A1 | * | 1/2004 | Buckley | 446/99 |
| 2005/0164598 | A1 | | 7/2005 | Kelsey | |
| 2006/0283775 | A1 | | 12/2006 | Mark | |
| 2007/0066396 | A1 | | 3/2007 | Weston et al. | |

OTHER PUBLICATIONS

Product Sample Photographs, "Betty—Chocolate Candy" and summary statement, 4 pages.

* cited by examiner

PACKAGED TOY WITH SELECTOR

CROSS-REFERENCE TO RELATED APPLICATION

This application claims priority to U.S. Provisional Patent Application Ser. No. 61/196,279, entitled "Doll Clothing Packaged with Cylindrical Fashion Selector Toy," filed Oct. 15, 2008, the disclosure of which is incorporated herein by reference in its entirety.

FIELD OF THE INVENTION

The present disclosure is directed generally to product packaging and, more specifically, to product packaging assembly with try-me toys that may allow a consumer to visualize, experiment, and design various looks available in the product line at the point of purchase while the product remains in the product packaging and after purchase.

BACKGROUND OF THE INVENTION

Representative examples of packaging for product shipment and retail display are disclosed in U.S. Pat. Nos. 4,411,382; 5,172,806; 5,855,499; and 6,012,842 and U.S. Patent Application Publication No. 2006/0283775. Examples of toys and structures with a plurality of movable elements representing human body parts and other visual designs are found in U.S. Pat. Nos. 1,064,576; 3,717,942; 3,830,012; 5,788,232; and 6,146,721. The disclosures of all the above-referenced patents and patent publication are incorporated herein by reference in their entirety for all purposes.

Some conventional toys include a doll and one or more accessories for the doll that are packaged together. Such conventional toys do not allow a user to see what the doll will look like with one or more accessories on the doll prior to purchasing the packaged toy. Sometimes children are unhappy with the purchased toy because it does not appear to be like the children anticipated or expected.

Accordingly, there is a need for a packaging assembly that allows a consumer to view different combinations of the products in the package. There is also a need for a packaged product that enables a consumer to experiment with the different combinations of the products in the package.

SUMMARY OF THE INVENTION

In one embodiment, a product packaging assembly includes a package, a plurality of products coupled to the package, and a selector coupled to the package, the selector including indicia representative of the plurality of products, the selector being adjustable to permit different combinations of the indicia to be viewed together. The selector includes a first section and a second section, the second section being movable relative to the first section. In one embodiment, the selector includes a third section movable relative to the first section and the second section. In one implementation, the selector is accessible from outside of the package. In another implementation, the package includes an opening and the selector is exposed via the opening.

In one embodiment, the selector includes a longitudinal axis and a first section and a second section, each of the first section and the second section being rotatable about the longitudinal axis. In another embodiment, the plurality of products includes a base product, the selector includes a first section and a second section, the first section includes indicia relating to a first portion of the base product and the second section includes indicia relating to a second portion of the base product.

In one embodiment, the plurality of products includes a base product, a first supplemental product, and a second supplemental product, each of the first supplemental product and the second supplemental product being engageable with the base product, the selector including a section including first indicia representing the base product and the first supplemental product and second indicia representing the base product and the second supplemental product. In an alternative embodiment, the base product is a toy figure, the first supplemental product is a first accessory, and the second supplemental product is a second accessory.

In one embodiment, the plurality of products includes a base product, a first supplemental product, a second supplemental product, a third supplemental product, and a fourth supplemental product, each of the supplemental products being engageable with the base product, the selector including a first section and a second section movable relative to the first section, the first section including first indicia representing the base product and the first supplemental product and second indicia representing the base product and the second supplemental product, the second section including third indicia representing the base product and the third supplemental product and fourth indicia representing the base product and the fourth supplemental product.

In an alternative embodiment, the selector is mounted to the package so that the first section and the second section are rotatable relative to each other. In another embodiment, the first section and the second section are adjustable relative to each other, thereby permitting one of the first indicia or the second indicia to be aligned with one of the third indicia or the fourth indicia. In another embodiment, the first indicia and the third indicia forms a first combination and the second indicia and the third indicia forms a second combination different than the first combination.

In one embodiment, the base product is a toy figure and the supplemental products are accessories for the toy figure.

In one embodiment, a packaged system includes a package, a base product coupled to the package, a plurality of supplemental products coupled to the package, each of the supplemental products being useable with the base product; and a display mechanism coupled to the package, the display mechanism being adjustable to display different combinations of the base product and at least some of the supplemental products.

In an alternative embodiment, the display mechanism includes a first portion and a second portion movable relative to the first portion, the first portion including a first representation of part of the base product and a first supplemental product and a second representation of part of the base product and a second supplemental product, the second portion including a third representation of part of the base product and a third supplemental product, the first portion and the second portion being adjustable so that different combinations of the representations are displayed.

In an alternative embodiment, the first and second supplemental products belong to a product category, and the third supplemental product belongs to a different product category.

In another embodiment, the base product is a toy figure, the first and second supplemental products are a first type of accessory for the toy figure, and the third supplemental product is a second type of accessory for the toy figure.

In one embodiment, a packaged system includes a package, a first product coupled to the package, a second product coupled to the package, a third product coupled to the package, and a selector coupled to the package, the selector including a portion having a first representation of the first product and the second product and a second representation of the first product and the third product, the portion being movable relative to the package so that one of the first representation or the second representation is displayed relative to the package.

In an alternative embodiment, the packaged system includes a fourth product coupled to the package, and a fifth product coupled to the package, the portion being a first portion and the selector including a second portion, the second portion having a third representation of the first product and the third product and a fourth representation of the first product and the fourth product, the second portion being movable relative to the first portion so that the combination of representations displayed relative to the package can be varied.

BRIEF DESCRIPTION OF THE DRAWINGS

Like reference numerals have been used to identify like elements throughout this disclosure.

DETAILED DESCRIPTION

Along with its functional features of protecting and storing enclosed products, product packaging assemblies may be configured to enhance product-viewing and product-promoting capabilities at points of purchase. The term "package" is used herein to refer to a container or structure that is configured to contain or receive one or more items or to which one or more items may be coupled. The package or container may receive all of the items therein or have at least some of the items coupled thereto.

Figure 1:
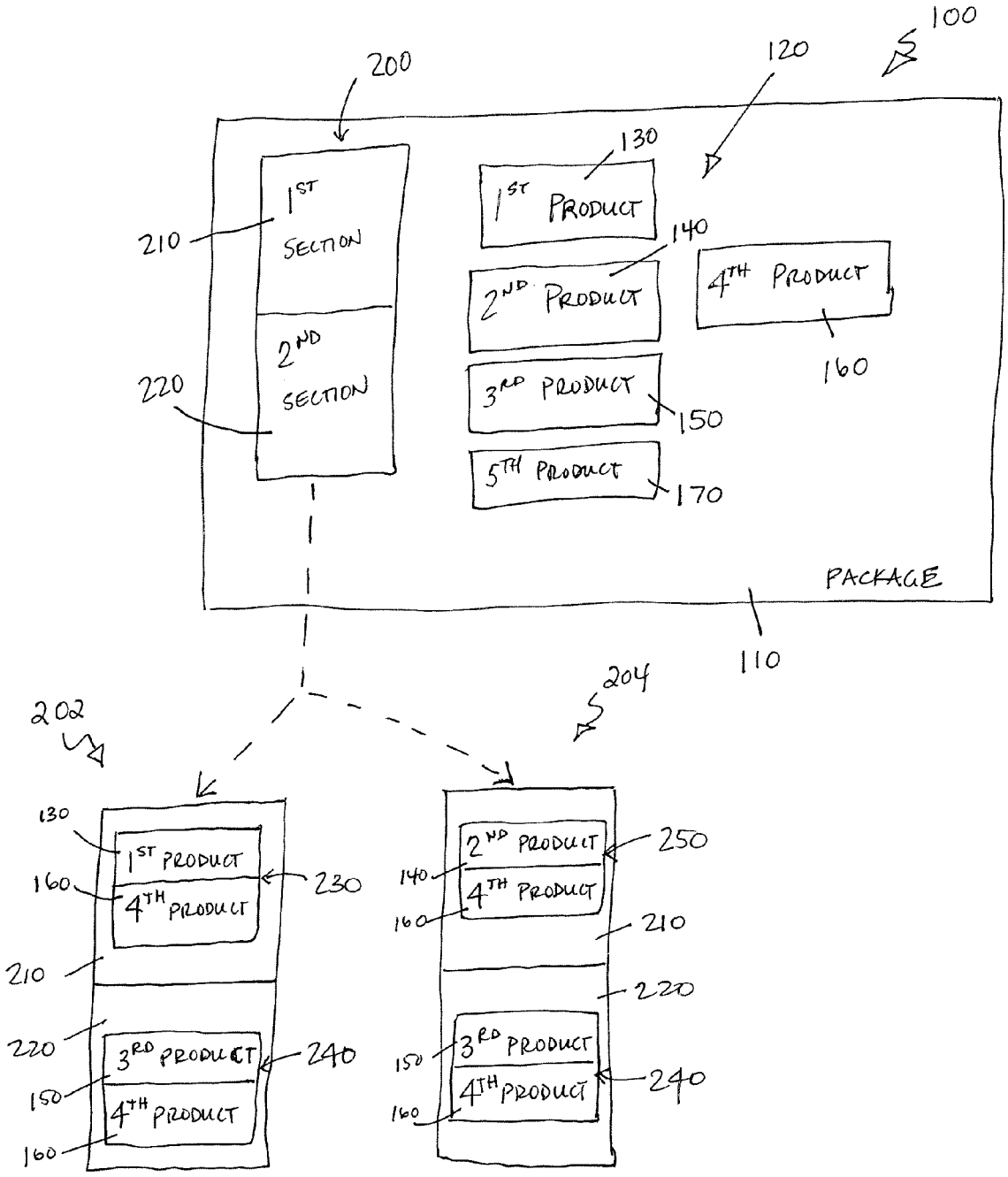
FIG. 1 illustrates a schematic diagram of an embodiment of a product packaging assembly.

Referring to FIG. 1, an exemplary embodiment of a product packaging assembly is illustrated. The product packaging assembly or system 100 includes a package or container 110 that contains various products that can be used together. In one embodiment, the package 110 is a plastic container that contains different products therein. For example, package 110 contains a set of products 120, which includes products 130, 140, 150, 160, 170. The different products 130, 140, 150, 160, and 170 may be used interchangeably with each other to allow for different combinations of play by a user, such as a child. The product packaging assembly 100 allows a consumer to view the different combinations of the products 130, 140, 150, 160, and 170 prior to purchasing the product, thereby allowing the consumer to confirm a desire for a particular product and avoiding an unnecessary and otherwise disappointing purchase.

In one embodiment, product 160 can be a base or main product with which the other products 130, 140, 150, and 170 can be used. For example, product 160 can be a toy figure, such as a doll, and products 130, 140, 150, and 170 can be accessories for the toy figure. Products 130, 140, 150, and 170 are engageable with product 160 and can be referred to as supplemental products.

The product package assembly 100 also includes a try-me or interactive display mechanism 200. The interactive display mechanism 200 can be referred to alternatively as a selector. In this embodiment, the display mechanism 200 has a first portion or section 210 and a second portion or section 220. The first section 210 and the second section 220 can be moved relative to each other, such as by rotating one or both of the sections 210 and 220. The display mechanism 200 is coupled to the package 110 and available with the product set 120 to a user or consumer.

As shown in FIG. 1, the display mechanism 200 can be reconfigured by moving one or both of the sections 210 and 220. For example, the first section 210 can be moved relative to the second section 220 so that a different part of the first section 210 is visible outside of the package 110. The different parts of the section 210 and 220 that are visible form different configurations or combinations 202 and 204, as described below.

The first section 210 has indicia thereon that includes a representation 230 of some of the products 120 that are included in the package 110. Representation 230 includes a portion or all of product 130 and a portion or all of product 160, which collectively form representation 230. In one embodiment, the portion of product 160 on first section 210 can be referred to as a first portion of product 160. The portions of products 130 and 160 shown on first section 210 show the portions 130 and 160 being used together.

Similarly, the second section 220 has indicia thereon that includes a representation 240 of some of the products 120 that are included in the package 110. Representation 240 includes a portion or all of product 150 and a portion or all of product 160, which collectively form representation 240. In one embodiment, the portion of product 160 on second section 220 can be referred to as a second portion of product 160. The portions of products 150 and 160 shown on second section 220 show the portions 150 and 160 being used together.

The representations 230 and 240 may be proximate to each other so that an image is collectively formed by the representations 230 and 240. For example, representation 230 may be an upper portion of a toy figure with an accessory and representation 240 may be a lower portion of the toy figure with an accessory. By having the images extend to the edges of sections 210 and 220, the representations 230 and 240 collectively form an image of the toy figure.

Also shown in FIG. 1 is another configuration 204 of the display mechanism 200. In this configuration, the first section 210 also has indicia thereon that includes a representation 250 of some of the products 120 that are included in the package 110. Representation 250 includes a portion or all of product 140 and a portion or all of product 160, which collectively form representation 250. The portions of products 140 and 160 shown on first section 210 show the portions 140 and 160 being used together.

In configuration 204, representations 250 and 240 may be proximate to each other so that an image is collectively formed by representations 250 and 240. For example, representation 250 may be an upper portion of a toy figure and representation 240 may be a lower portion of the toy figure.

In this embodiment, representation 250 is an alternative to representation 230. Accordingly, a user may move the first section 210 and the second section 220 relative to each other so that either representation 230 or representation 250 is proximate to representation 240 to create an image or appearance as desired. As a result, the user can see different combinations of the products 120 included in the package 110 prior to purchasing and/or opening or removing the products 120 from the package 110.

Figure 2:
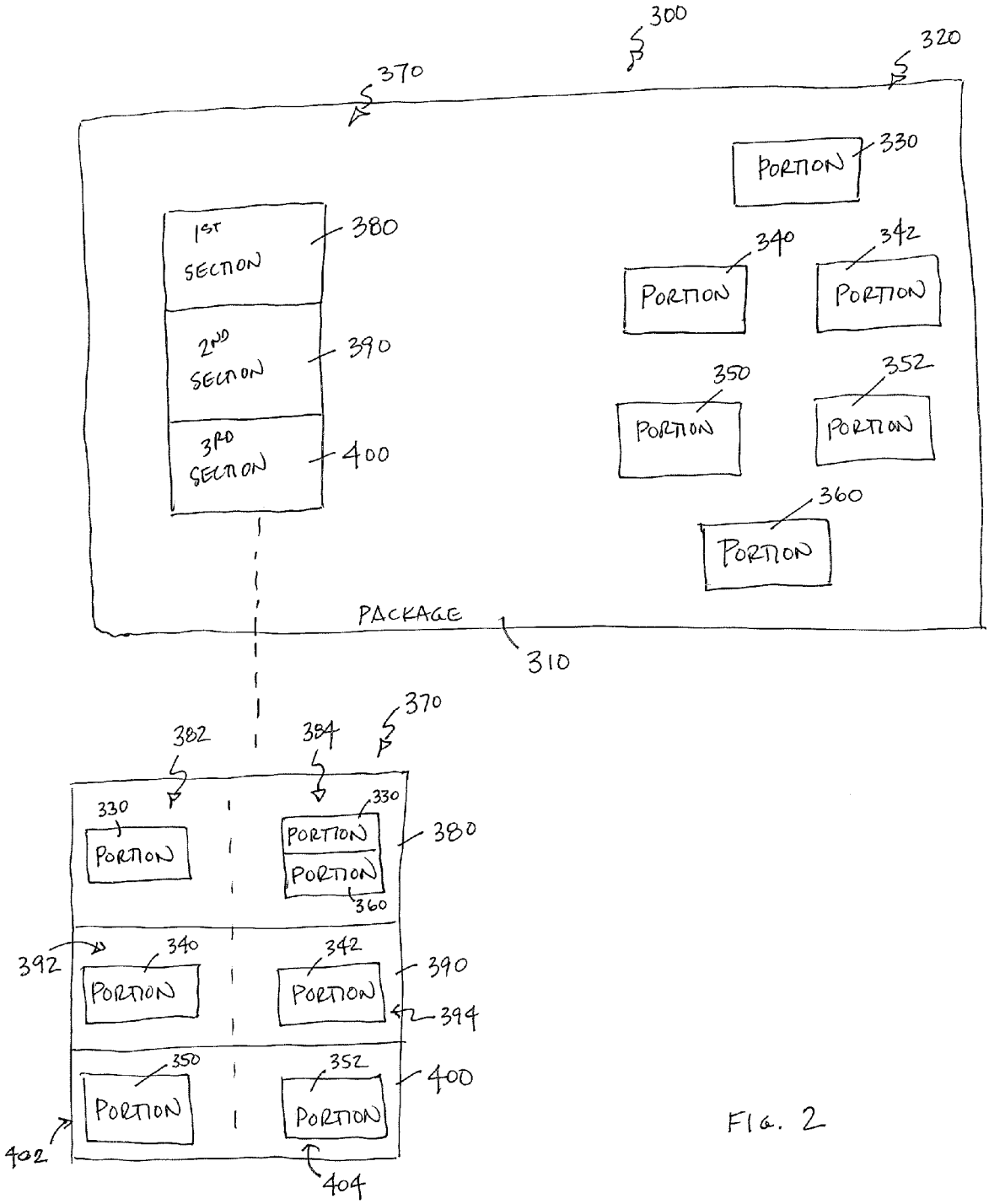
FIG. 2 illustrates a schematic diagram of an alternative embodiment of a product packaging assembly.

Referring to FIG. 2, a schematic diagram of an alternative embodiment of a product packaging assembly is illustrated. In this embodiment, the product packaging assembly or system 300 includes a package or container 310. Enclosed within or coupled to the package 310 are several products or portions 320 of an overall product. For example, the portions 320 may be different portions or parts of a main toy, such as a toy figure. Some of the portions 320 may be interchangeably used to form different variations of the toy figure, as set forth below.

In this embodiment, there are several products or product portions 330, 340, 342, 350, 352, and 360 in or coupled to the package 310. The package 310 also includes a display mechanism or try-me portion 370 that is coupled to the package 310. The display mechanism 370 can be referred to alternatively as a selector. The display mechanism 370 is accessible from outside of the package 310 so that a user can contact and manipulate the display mechanism 370 to see the different combinations of the products or product portions included in the package prior to purchasing or opening the product 300.

In one embodiment, the display mechanism 370 has three sections 380, 390, and 400 which are movable relative to each other. For example, the sections 380, 390, and 400 can be rotated relative to each other so that the parts of the sections 380, 390, and 400 that are visible vary. In other embodiments, the quantity of portions 320 and the quantity of sections of the mechanism 370 may vary. Each of the sections 380, 390, and 400 includes indicia thereon that relates to the product portions 320 that are included with the package 310. In one embodiment, each of the sections 380, 390, and 400 includes two or more representations thereon that relate to the product portions 320. In other embodiments, the quantity of representations on the sections 380, 390, and 400 may vary.

Referring to FIG. 2, each of the sections 380, 390, and 400 has been illustrated as being laid flat so that the different representations on each of the sections 380, 390, and 400 are visible. Section 380 includes representations 382 and 384 and the display mechanism 370 is coupled to the package 310 so that at least one of the representations 382 and 384 is visible outside of the package 310. Representation 382 includes an image or illustration of portion 330, which in one implementation is part of a toy figure, such as the neck and head of the toy figure. Representation 384 includes an image or illustration of portion 330 and portion 360, which are illustrated together. In one implementation, portion 360 is an accessory for the head of the toy figure. Thus, the user can manipulate section 380 so that only portion 330 is displayed or both portions 330 and 360 are displayed together.

Referring to FIG. 2, section 390 has representations 392 and 394. In this embodiment, representation 392 includes an image or illustration of product portion 340. Similarly, representation 394 includes an image or illustration of product portion 342. Each of the product portions 340 and 342 can be an upper portion or section of the body of a toy figure with different accessories or apparel coupled thereto. In one embodiment, portion 340 may include the arms of a toy figure and a shirt, a jacket, and/or top portion of apparel on the arms. The arms of the toy figure can be coupled to portion 330, which may include a torso of the toy figure. Portion 342 may include alternative arms of a toy figure and a different piece of apparel that is mounted on the alternative arms. The user can manipulate section 390 so that either portion 340 or portion 342 is displayed and so that the combination of either portion 340 or portion 342 with portion 330 or portions 330 and 360 is visible. The user can create different combinations of the representations on sections 380 and 390 that correspond to different portions 320 included in the package 310.

Similarly, section 400 has representations 402 and 404. In this embodiment, representation 402 includes an image or illustration of product portion 350. Similarly, representation 404 includes an image or illustration of product portion 352. The user can manipulate section 400 so that either portion 350 or portion 352 is displayed. Each of the portions 350 and 352 can be a lower section or portion of the body of a toy figure with one or more different accessories or apparel coupled thereto. In one embodiment, portion 350 may include the legs of a toy figure and an article of clothing or apparel, such as pants, shorts, a skirt, and/or bottom, on the legs. The legs of the toy figure can be coupled to portion 330, which may include a torso of the toy figure. Portion 352 may include the legs of a toy figure and a different piece of apparel that is mounted on the legs. The user can manipulate section 400 so that either portion 350 or portion 352 is displayed and the combination of either portion 350 or portion 352 with the available combinations of portion 330, portions 330 and 360, and portion 340 or 342 is visible.

The user can create different combinations of the representations on sections 380, 390, and 400 that correspond to different product portions 320 included in the package 310. This arrangement allows a user to view the various combinations of products available in the package prior to purchasing the product 300. In some combinations, some but not all of the products in the container or package are viewable on the selector or display mechanism.

Figure 3:
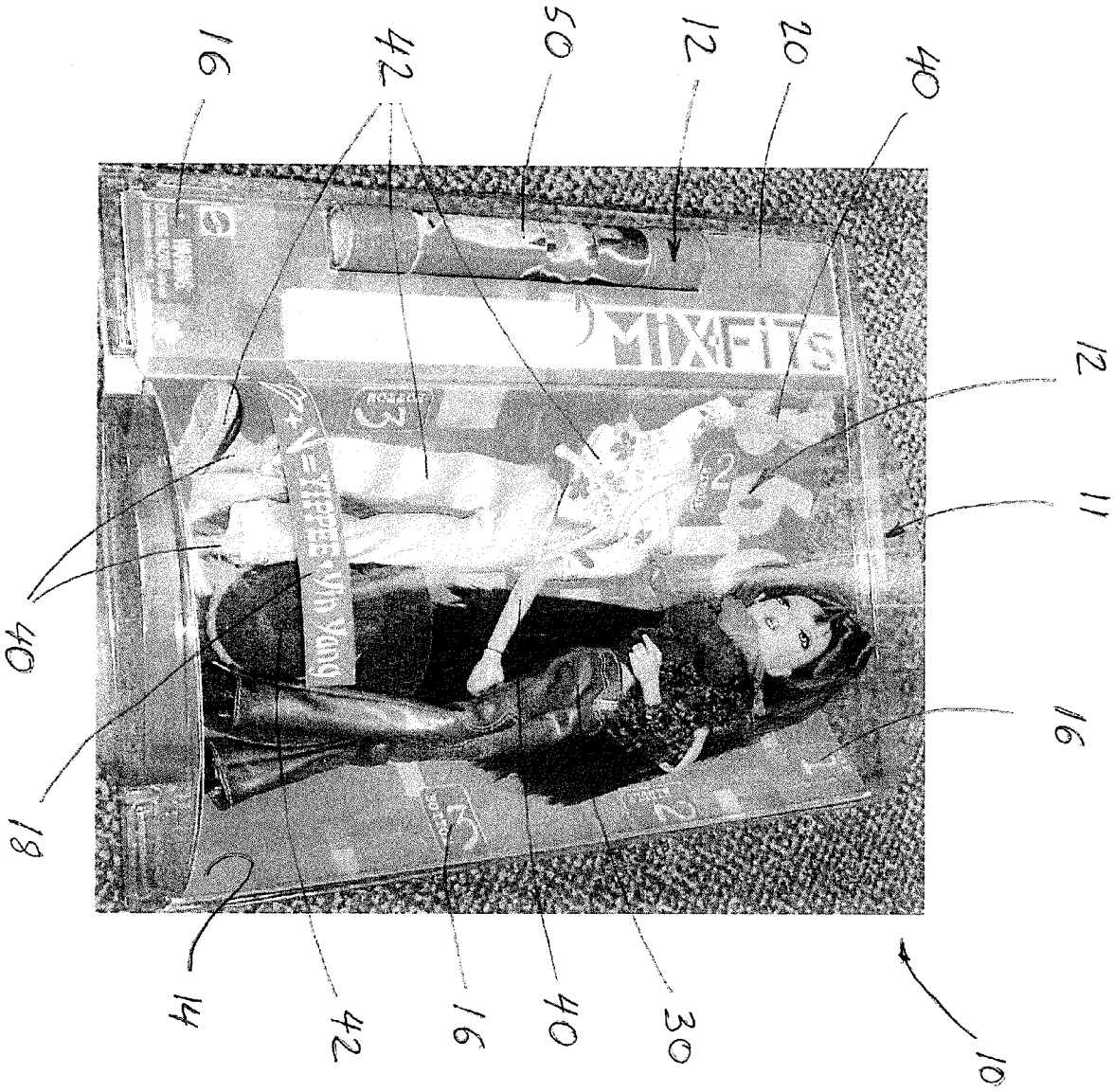
FIG. 3 illustrates a perspective view of an alternative embodiment of a product packaging assembly.
Figure 4:
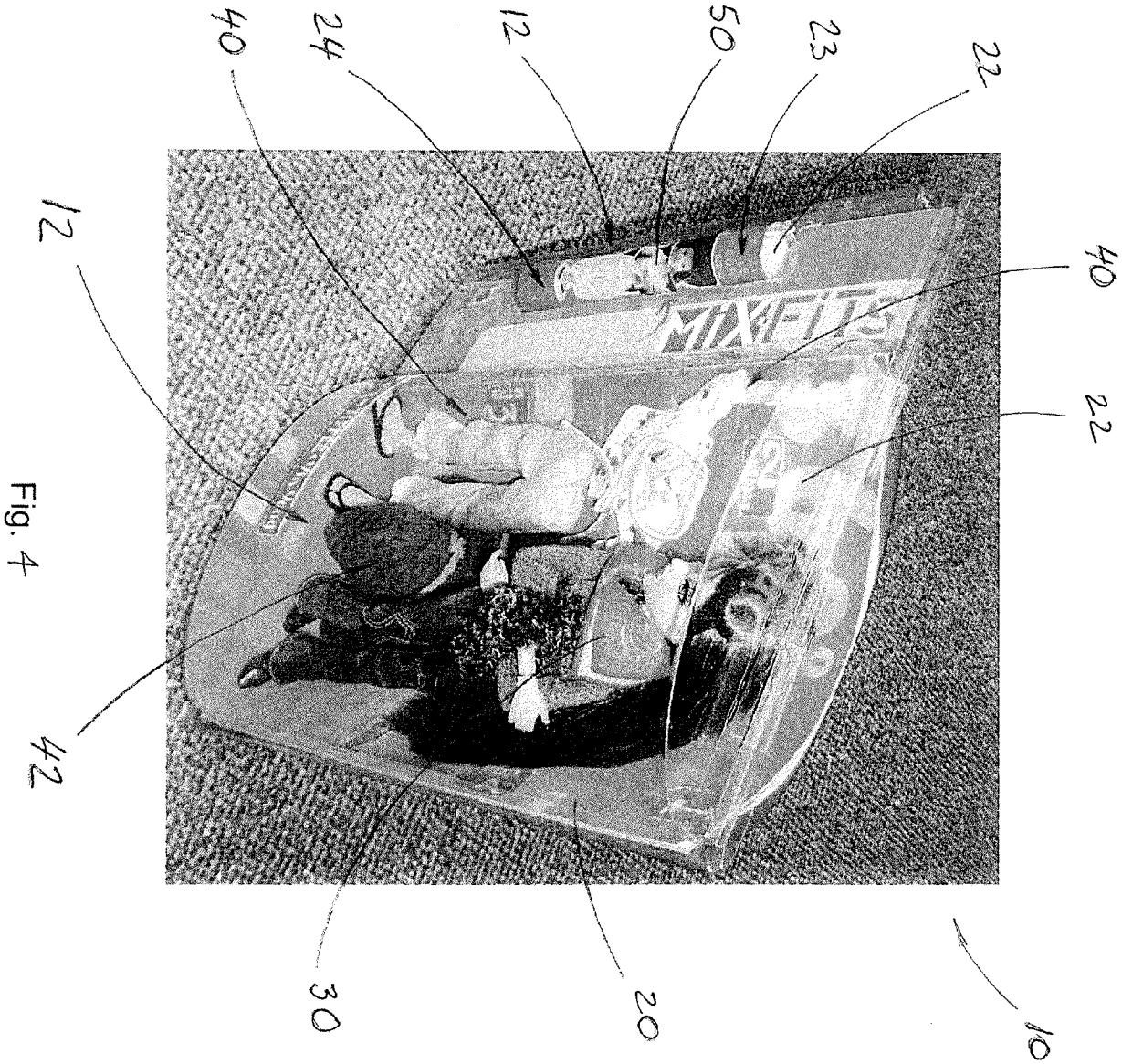
FIG. 4 illustrates another perspective view of the product packaging assembly illustrated in FIG. 3.
Figure 5:
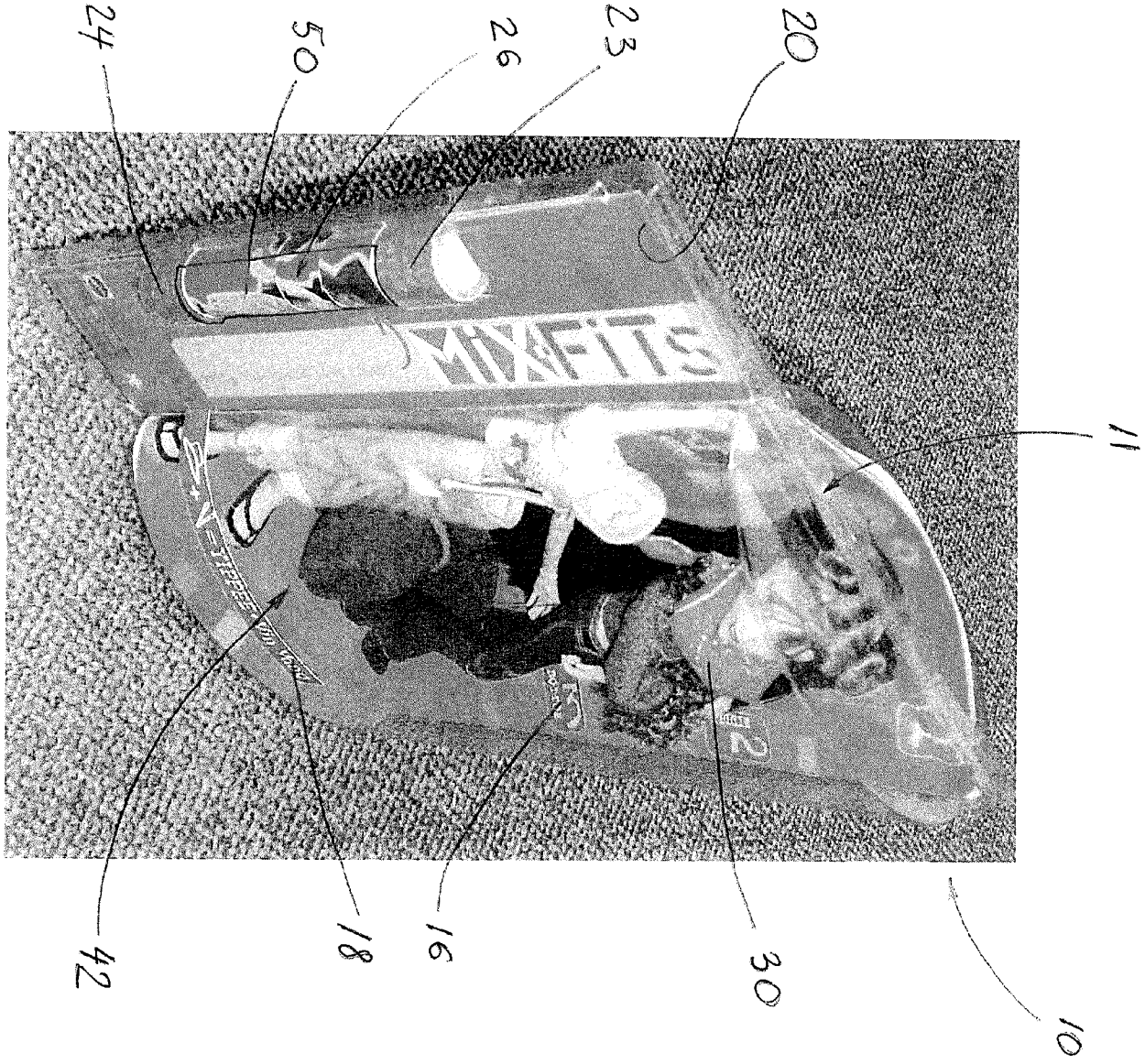
FIG. 5 illustrates another perspective view of the product packaging assembly illustrated in FIG. 3.

Consumer products may be marketed and sold in product packaging assemblies, such as a product packaging assembly 10 shown in FIGS. 3-5. Product packaging assembly 10 may include a package 11, products 12, and one or more inserts 14 contained in the package. As described in greater detail below, products 12 and their respective components may be placed in product package 11 for transport; storage, and/or display. Products 12 may be housed, or partially housed, within product package 11 and may include any number and combination of consumer products.

In the example in FIG. 3, product packaging assembly 10 may include a package in the form of a cover or container 20, a doll 30 with body parts 40 and accessories 42, including garments, appropriate for doll 30, and a fashion selector or try-me toy 50, housed within container 20. Container 20 may be wholly or partially transparent and may be configured so as to protect doll 30 and the respective components during shipment and at points of purchase until a consumer has purchased product 12.

An insert 14, formed of any suitable material, may be placed within container 20 to affix labels 16 for and may be imprinted with advertisements, pricing, and other manufacturer and consumer information. Labels, such as a label 18, may also be affixed on the surface of container 20. Container 20 may be made out of transparent plastic or any other suitable transparent substance so as to permit a consumer to see product 12 while in product packaging assembly 10. Optionally, container 20 may have one or more handles facilitating manipulation and display of product packaging assembly 10 (not shown).

As illustrated in FIG. 4, container 20 may further include one or more regions or compartments 22 of various shapes suitable to house doll 30 and associated products 12 so that doll 30 and associated products 12 may be positioned and/or held by being fitted into compartments 22. Each compartment 22 may include internal holding members (not shown) or may be molded to mount and separate doll 30 and body parts 40 and accessories 42 so that they do not collide during transportation and/or display. As will be seen, portions of container 20 may also be configured to form external holding members 23 and 24 for supporting try-me toy 50 in a fixed position within container 20.

A consumer may wish to select a doll based on particular looks and/or a specific combination of outfits available in the product line. Consequently, as seen in FIG. 5, container 20 may include at least one opening 26 exposing at least a portion of try-me toy 50 to provide a consumer with access to try-me toy 50 for manipulating and mixing and matching accessories 42 available for doll 30 in a particular product packaging assembly. Opening 26 may be on one or more sides of container 20 and may extend along one or more portions of try-me toy 50. In the present example, try-me toy 50 may be positioned and held within container 20 by having opposite outer ends of try-me toy 50 securely fitted into respective external holding members 23 and 24 of container 20.

Figure 6:
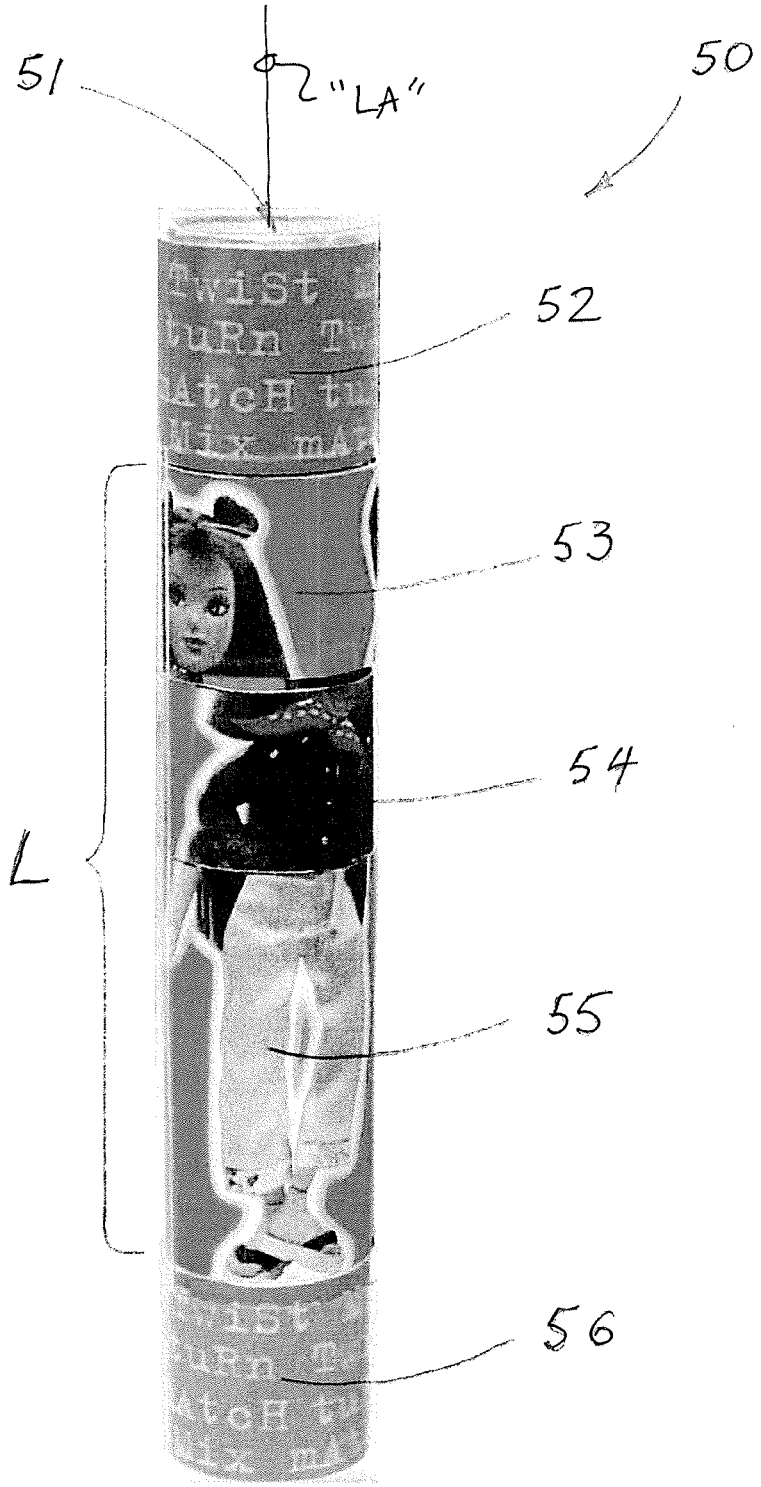
FIG. 6 illustrates a front view of an embodiment of a try-me toy included in the product packaging assembly illustrated in FIGS. 3-5.

An example of try-me toy or selector 50 is illustrated in FIG. 6. Try-me toy 50 may include a plurality of independent sections 52-56 arranged in consecutive order adjacent to each other on and rotatable about a common tubular structure 51. The selector 50 has a longitudinal axis "LA" as shown in FIG. 6. Try-me toy 50 may be fabricated from any suitable material, such as pressed paper, cardboard, plastic, fabric, wood, metal, or any combination of materials to provide a desirable synergy of weight, strength, durability, cost, and/or manufacturability.

Optionally, outer end sections 52 and 56 may not be rotatable and may be permanently secured to respective end portions of tubular structure 51. In the configuration shown, independently rotatable sections 53, 54, and 55 may be held together by outer sections 52 and 56. The opposing edges of each section may abut each other so as to make a substantially continuous external surface over the associated length of try-me toy 50. Optionally, there may be a space between two or more of the respective sections of try-me toy 50.

As a way of illustration, a mounting portion L of try-me toy 50 may be configured to accommodate three rotatable sections 53, 54, and 55. It should be noted that depending on the nature of the product, the length of mounting portion L may be configured to accommodate more or fewer rotatable sections.

Each rotatable section 53, 54, and 55 may contain a plurality of representations or images representing various body parts of doll 30. Each of the body parts can be referred to as a product or product portion. For example, section 53 may contain various images of different looking heads and hair; section 54 may contain various images of a torso or upper body portion with different outfits and accessories; and section 55 may contain various images of different looking bottoms and shoes. When all of the sections of try-me toy 50 have the proper rotational position with the images continuously aligned, the desired visual representation of a complete doll is displayed.

Sections 52 and 56 may or may not be left unprinted with images of doll 30 and/or may contain advertisements or other consumer information. It should be appreciated that visual images may vary and may depict any object of any kind with features that relate to product 12 enclosed in container 20. Such objects may be, for example, in the form of a soldier and weaponry, a car and wheel options, a plant and leaves, or any other representation determined to be suitable for a consumer.

As mentioned, in operative use, sections 53, 54, and 55 may be selectively aligned by a consumer so as to form a plurality of complete pictures representing different fashion looks for doll 30 available within product packaging assembly 10. A consumer, thus, may experiment at the point of purchase with different fashion looks by mixing and matching various clothing accessories available in the product line. Optionally, after purchase, a consumer may want to retain and use try-me toy 50 to play and design new fashion looks for doll 30 after container 20 has been discarded.

Figure 7:
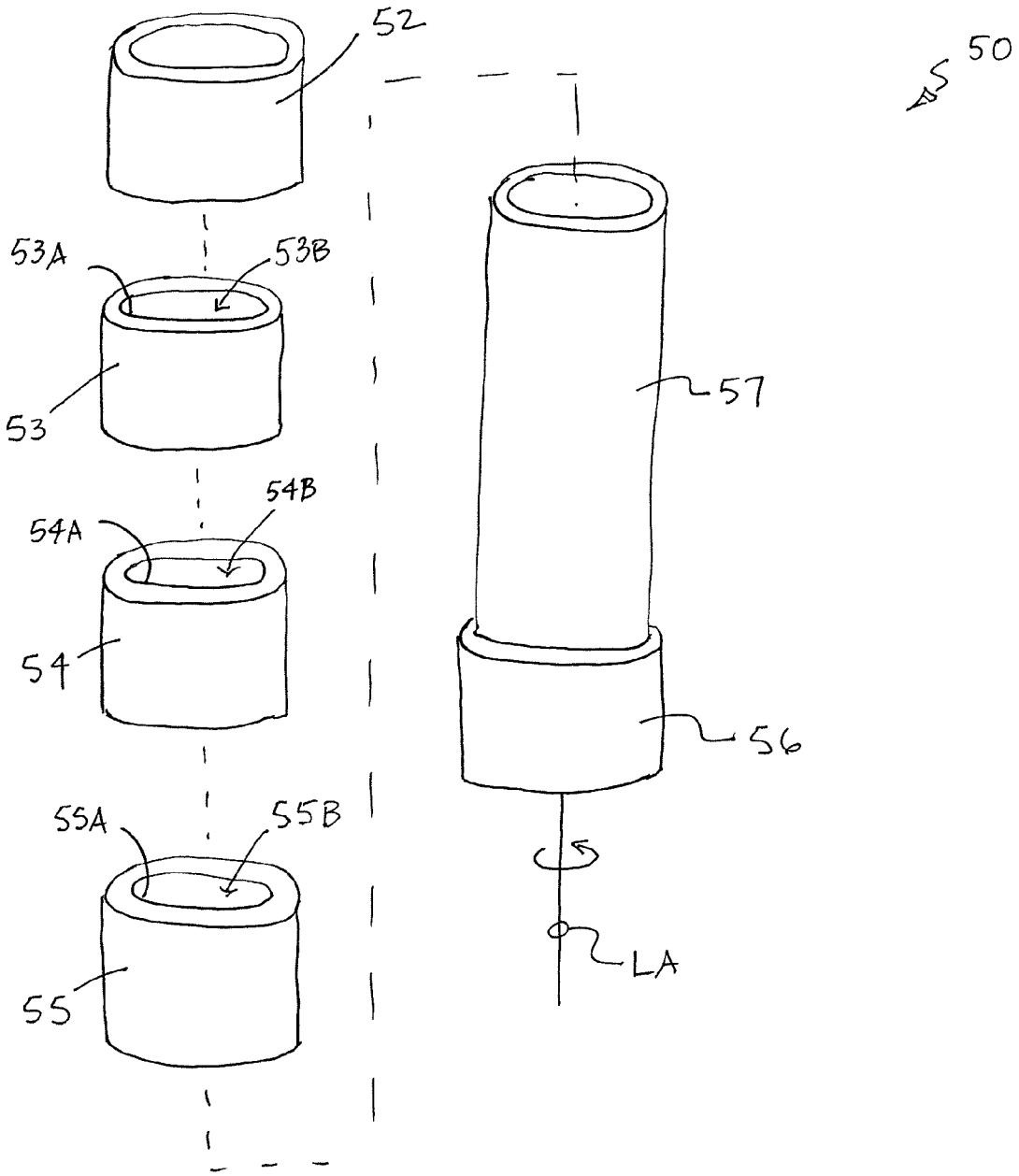
FIG. 7 illustrates a front exploded view of the toy illustrated in FIG. 6.

Referring to FIG. 7, an embodiment of a display mechanism or try-me toy 50 is illustrated. In this embodiment, the mechanism 50 includes an outer end section 56 to which a cylindrical member 57 is coupled. Each of the rotatable sections 53, 54, and 55 is cylindrical and includes an inner surface 53A, 54A, and 55A that defines an opening 53B, 54B, and 55B therethrough. The openings 53A, 54B, and 55B are sized so that the sections 53, 54, and 55 can be slid onto the member 57. The sections 53, 54, and 55 are freely rotatable about the member 57. An end section 52 is coupled to the tubular member 57 via an adhesive or other connecting mechanism or technique to maintain the sections 53, 54, and 55 in place on the display mechanism 50.

Figure 8:
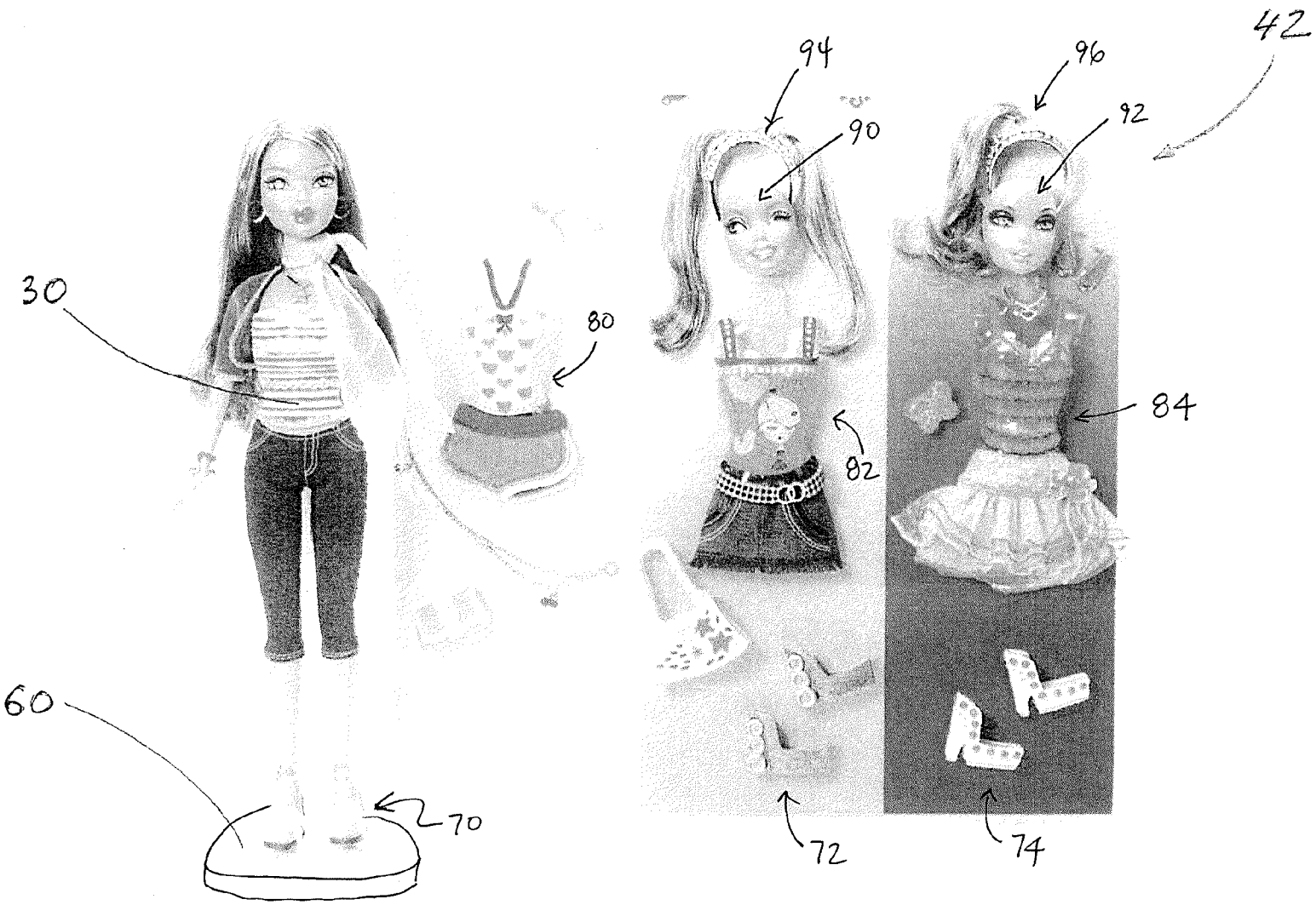
FIG. 8 illustrates a doll mounted on a pedestal and accessories for the doll.

As illustrated in FIG. 8, doll 30 may include a wide variety of accessories 42, such as, for example, hair bands, hair clips, hats, tiaras, eyeglasses, charms, bracelets, scarves, barrettes, necklaces, brooches, jewelry, jackets, tank tops, belts, shoes, purses, earrings, shorts, skirts, kimonos, jeans, pants, boots, flip-flops, dog leashes, and so forth. In addition, doll 30 may be provided with and positioned on a base or pedestal 60. As shown, the set of products that can be included in a package may include different head portions 90 and 92, different hair portions 94 and 96, different apparel portions 80, 82, and 84, and different footwear 72 and 74. The various head portions, hair portions, apparel portions, and footwear are from different product categories and can be used as supplemental products to decorate and create different versions of the underlying toy figure or base product. In alternative embodiments, the quantity accessories and the possible combinations of product portions can vary.

In various embodiments, a user can manipulate and align the different sections of the selector or display mechanism so that a particular combination of the base product and one or more supplemental products or accessories can be displayed. In one implementation, the representations can be different images or photographs. In some embodiments, the representations may include different looking heads, upper bodies with different garment tops, and lower bodies with different garment bottoms. By aligning different sections of the selector, different combinations of the products or product portions in the package can be displayed, allowing a user to mix and match the various doll outfits available in the product line.

While embodiments of a toy and methods of toy play have been particularly shown and described, many variations may be made therein. This disclosure may include one or more independent or interdependent embodiments directed to various combinations of features, functions, elements and/or properties. These and other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

Each example defines an embodiment disclosed in the foregoing disclosure, but anyone example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A product packaging assembly, comprising:

a package including a selector, at least a portion of the selector being enclosed by the package; and a plurality of products coupled to the package, at least a portion of each of the plurality of products being enclosed by the package, the a selector being spaced apart from the plurality of products, and including indicia representative of the plurality of products, the selector being adjustable to permit different combinations of the indicia to be viewed together while the plurality of products are coupled to the package.

2. The product packaging assembly of claim 1, wherein the selector includes a first section and a second section, the second section being movable relative to the first section.

3. The product packaging assembly of claim 2, wherein the selector includes a third section movable relative to the first section and the second section.

4. The product packaging assembly of claim 1, wherein the selector is accessible from outside of the package.

5. The product packaging assembly of claim 1, wherein the package includes an opening and the selector is exposed via the opening.

6. The product packaging assembly of claim 1, wherein the selector includes a longitudinal axis and a first section and a second section, each of the first section and the second section being rotatable about the longitudinal axis.

7. The product packaging assembly of claim 1, wherein the plurality of products includes a base product, the selector includes a first section and a second section, the first section includes indicia relating to a first portion of the base product and the second section includes indicia relating to a second portion of the base product.

8. The product packaging assembly of claim 1, wherein the plurality of products includes a base product, a first supplemental product, and a second supplemental product, each of the first supplemental product and the second supplemental product being engageable with the base product, the selector including a section including first indicia representing the base product and the first supplemental product and second indicia representing the base product and the second supplemental product.

9. The product packaging assembly of claim 8, wherein the base product is a toy figure, the first supplemental product is a first accessory, and the second supplemental product is a second accessory.

10. The product packaging assembly of claim 1, wherein the plurality of products includes a base product, a first supplemental product, a second supplemental product, a third supplemental product, and a fourth supplemental product, each of the supplemental products being engageable with the base product, the selector including a first section and a second section movable relative to the first section, the first section including first indicia representing the base product and the first supplemental product and second indicia representing the base product and the second supplemental product, the second section including third indicia representing the base product and the third supplemental product and fourth indicia representing the base product and the fourth supplemental product.

11. The product packaging assembly of claim 9, wherein the first section and the second section are rotatable relative to each other.

12. The product packaging assembly of claim 10, wherein the first section and the second section are adjustable relative to each other, thereby permitting one of the first indicia or the second indicia to be aligned with one of the third indicia or the fourth indicia.

13. The product packaging assembly of claim 10, wherein the first indicia and the third indicia forms a first combination and the second indicia and the third indicia forms a second combination different than the first combination.

14. The product packaging assembly of claim 8, wherein the base product is a toy figure and the supplemental products are accessories for the toy figure.

15. The product packaging assembly of claim 10, wherein the base product is a toy figure, the first supplemental product is a first article of apparel including a first bottom that is configured to be coupled to the toy figure, the second supplemental product is a second article of apparel including a second bottom that is configured to be coupled to the toy figure, the second bottom being different than the first bottom, the third supplemental product includes a pair of toy skates to be coupled to the toy figure, and the fourth supplemental product includes a pair of toy shoes to be coupled to the toy figure.

16. A packaged system, comprising:

a package including a display mechanism;

a base product coupled to the package;

a plurality of supplemental products coupled to the package, each of the supplemental products being useable with the base product, the display mechanism being adjustable to display different combinations of the base product and at least some of the supplemental products, the base product and the plurality of supplemental products being spaced from the display mechanism.

17. The packaged system of claim 16, wherein the display mechanism includes a first portion and a second portion movable relative to the first portion, the first portion including a first representation of part of the base product and a first supplemental product and a second representation of part of the base product and a second supplemental product, the second portion including a third representation of part of the base product and a third supplemental product, the first portion and the second portion being adjustable so that different combinations of the representations are displayed.

18. The packaged system of claim 17, wherein the first and second supplemental products belong to a product category, and the third supplemental product belongs to a different product category.

19. The packaged system of claim 18, wherein the base product is a toy figure, the first and second supplemental products are a first type of accessory for the toy figure, and the third supplemental product is a second type of accessory for the toy figure.

20. A packaged system, comprising:

a package including a selector;

a first product coupled to the package;

a second product coupled to the package;

a third product coupled to the package, the selector being spaced apart from the first product, the second product, and the third product and including a portion having a first representation of the first product and the second product and a second representation of the first product and the third product, the portion being movable relative to the package so that one of the first representation or the second representation is displayed relative to the package, the first product, the second product, and the third product remaining in place and coupled to the package while the portion moves relative to the package.

21. The packaged system of claim 20, further comprising:

a fourth product coupled to the package; and a fifth product coupled to the package, the portion being a first portion and the selector including a second portion, the second portion having a third representation of the first product and the third product and a fourth representation of the first product and the fourth product, the second portion being movable relative to the first portion so that the combination of representations displayed relative to the package can be varied.

* * * * *